United States Patent [19]

Shiba et al.

[11] Patent Number: 4,702,024

[45] Date of Patent: Oct. 27, 1987

[54] HELICAL DREDGE CUTTER HEAD WITH SCOOP-IN PLATES

[75] Inventors: Toyoaki Shiba; Seiichi Goto; Keishi Ito, all of Tokyo, Japan

[73] Assignee: Toyo Construction Co., Ltd., Osaka, Japan

[21] Appl. No.: 839,290

[22] Filed: Mar. 13, 1986

[30] Foreign Application Priority Data

Dec. 28, 1985 [JP] Japan ..... 60-199863[U]

[51] Int. Cl.[4] ..... F02F 3/92

[52] U.S. Cl. ..... 37/67

[58] Field of Search ..... 37/64–67, 37/195

[56] References Cited

U.S. PATENT DOCUMENTS 682,024 9/1901 Bradley ..... 37/67
1,087,269 2/1914 Baltz ..... 37/67

FOREIGN PATENT DOCUMENTS 8534 3/1980 European Pat. Off. ..... 37/67
757647 8/1980 U.S.S.R. ..... 37/67

*Primary Examiner*—Clifford D. Crowder
*Attorney, Agent, or Firm*—Parkhurst & Oliff

[57] ABSTRACT

A dreging helical cutter suited for use, for example, with a dredger is equipped according to the present invention with scoop-in plates. Earth and sand is transported by helical vanes to a send-out end portion of the helical cutter. The scoop-in plates transport the earth and sand to an opening of an earth/sand suction tube. The opening of the suction tube is provided in a portion of the helical cutter for receiving a rotary shaft. All of the earth and sand excavated by the helical cutter can therefore be sucked into the suction tube and the efficiency of the dredging operation can be greatly increased by a simple structure.

8 Claims, 6 Drawing Figures

HELICAL DREDGE CUTTER HEAD WITH SCOOP-IN PLATES

BACKGROUND OF THE INVENTION

This invention relates to a dredging helical cutter and a method for more efficiently dredging an underwater area. In the past, dredgers have had the general configuration shown in FIGS. 4 and 5, wherein on one end section of a hull 8, the base end portion of a rudder 9, which is swung vertically depending upon the depth of the bottom of the water, is attached to a transverse shaft 10. A suspension rope 11, suspended from a winch provided on the hull 8, is coupled to the point portion of the rudder 9 through a pulley provided on the point of a boom 12 fixed on the hull 8. The point portion of the rudder 9 is equipped with a cutter 13 which is rotated by a driving device. In the other end section of the hull 8, a first spud 14 and second spud 15 are provided. The first and second spuds 14 and 15, are elevatably movable and mutually spaced in the widthwise direction of the ship.

When the ground at the bottom of the water is to be excavated using this dredger, the first spud 14 is fixed to the ground 16. The first step of excavation is performed using the cutter 13, which is spaced R meters from the first spud 14, while turning the hull 8 and rudder 9 laterally in either direction. For example, after the rudder 9 is rotated downward a given angle (i.e., the angle corresponding to the distance through which the cutter 13 moves down, which is about one-half of the diameter of the cutter), the hull 8 and rudder 9 are moved laterally clockwise about the first spud 14. The second step of the excavation is performed while turning the hull 8 and rudder 9 counterclockwise. After the rudder 9 is rotated downward a given angle, the third step of the excavation is performed while again turning the hull 8 and rudder 9 clockwise.

After the repetitive turning excavation described above has reached a given depth, the cutter 13 is kept at the final right turn position, the rudder 9 is rotated upward, the second spud 15 is put through the ground 16, the first spud 14 is pulled out, the hull 8 and rudder 9 are turned counterclockwise about the second spud 15 up to the final left turn position, the first spud 14 is put through the ground 16 at position 14A, the second spud 16 is pulled out (through the foregoing series of operations, the hull 8 has moved and advanced in the forward direction of excavation), and a second repetitive turning excavation similar to the first one is performed. Then, a series of operations similar to that described above is repeated, and successively, the repetitive turning excavations are performed.

Conventional cutters used in the foregoing dredger are of the helical type, as shown in FIG. 6. Helical vanes 3 are fixed on a rotary body 2, which is fitted and secured to a driving shaft 1. A number of excavating picks 4 are attached to the periphery of each helical vane 3, and an inlet port 6 of an earth/sand suction tube 5 supported by a bearing 22 fitted on the driving shaft 1, is disposed opposite to the lower portion of the send-out end portion (i.e., the end portion of the vanes of the helical cutter toward which sand and dirt to be excavated is moved) of the helical vanes 3.

When the foregoing conventional helical cutter is used to dredge, earth and sand and the like, excavated by the picks 4, are conveyed by the helical vanes 3 toward the inlet port 6 while being guided along an excavated plane 18. However, a greater part of earth and sand flows out along a previously excavated, formed, inclined plane 19 after reaching the inlet-port side end portion, i.e., the terminated portion, of the excavated plane 18, thereby causing inefficiency in the suction of earth and sand by the earth/sand suction tube 5.

SUMMARY OF THE INVENTION

This invention was developed in view of the foregoing background and to overcome the foregoing drawbacks.

It is accordingly an object of the present invention to provide a helical cutter with scoop-in plates to ease suction of earth and sand into a suction tube, thereby enhancing the efficiency of suction of earth and sand into the suction tube.

It is a further object of the invention to provide a method for dredging which includes a step of transporting earth and sand from a send-out end portion of a helical cutter to a suction tube.

To achieve the foregoing object, the present invention provides a helical cutter of the type wherein helical vanes are fixed on a rotary body which is secured to a driving shaft. A number of excavating picks are attached to the periphery of each helical vane, and an inlet portion of an earth/sand suction tube is disposed opposite to a send-out end portion of the helical vanes. Scoop-in plates are attached in the vicinity of the periphery of the send-out end portion of the helical vanes.

According to the helical cutter of the present invention, the scoop-in plates attached to the send-out end portion of the helical vanes function so that earth and sand are excavated and conveyed toward the inlet port of the suction tube and guided along an excavated plane by means of the helical vanes and, when the earth and sand reach a location close to the end portion of the excavated plane, the earth and sand are scooped in by means of the scoop-in plates and led toward the inlet port. Thus, little of the earth and sand excavated flows out from the terminated portion of the excavated plane. Instead, the earth and sand are led toward the inlet port with the water. As a result, the efficiency of suction of earth and sand achieved by the earth/sand suction tube is enhanced. This invention, therefore, provides a simple and economical method and means to increase the efficiency of suction during a dredging operation.

BRIEF DESCRIPTION OF THE DRAWINGS

The above objects, features and advantages of the present invention will become more apparent from the description of the invention which follows, taken in conjunction with the accompanying drawings, wherein like reference numerals denote like elements, and wherein.

The present invention will be described in detail with reference to the accompanying drawings which illustrate a preferred embodiment according to the present invention.

DESCRIPTION OF THE PREFERRED EMBODIMENT

Figure 1:
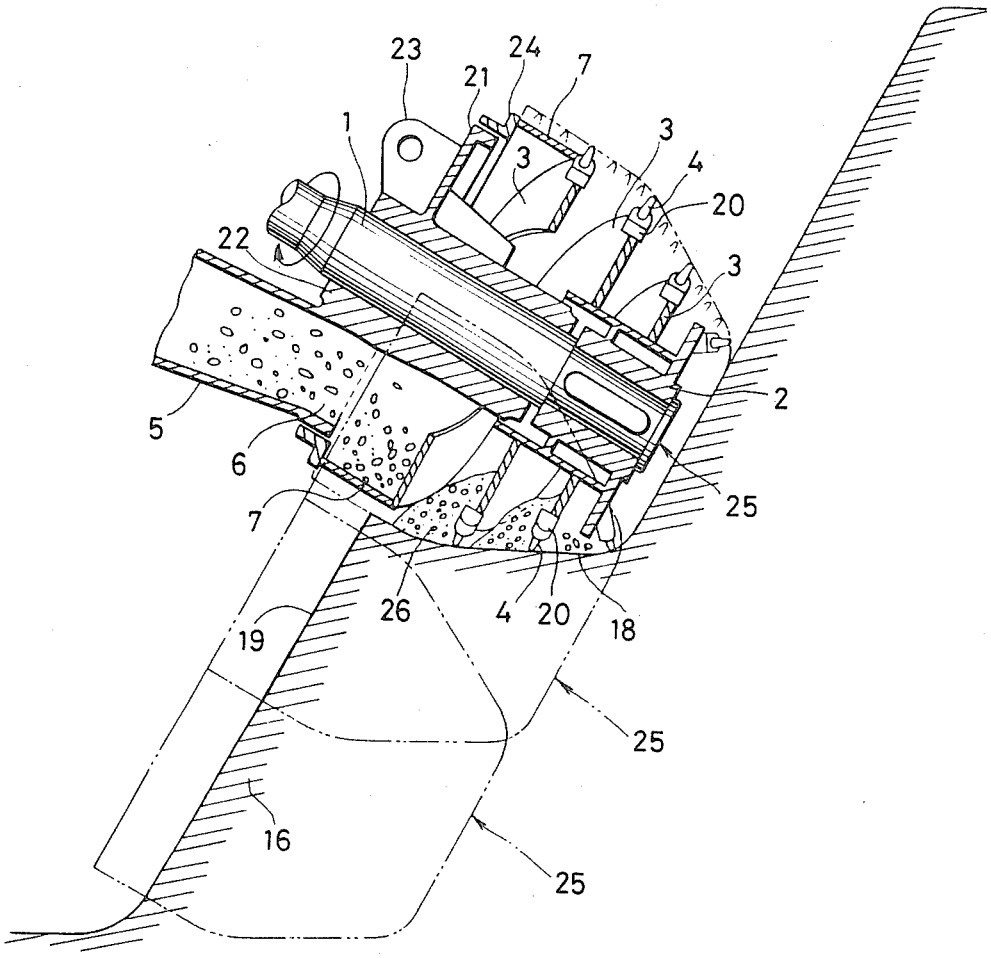
FIG. 1 is a longitudinal sectional view showing a dredger, according to an embodiment of the present invention, including a helical cutter with scoop-in plates in position to excavate the ground of the bottom of an area of the water.
Figure 2:
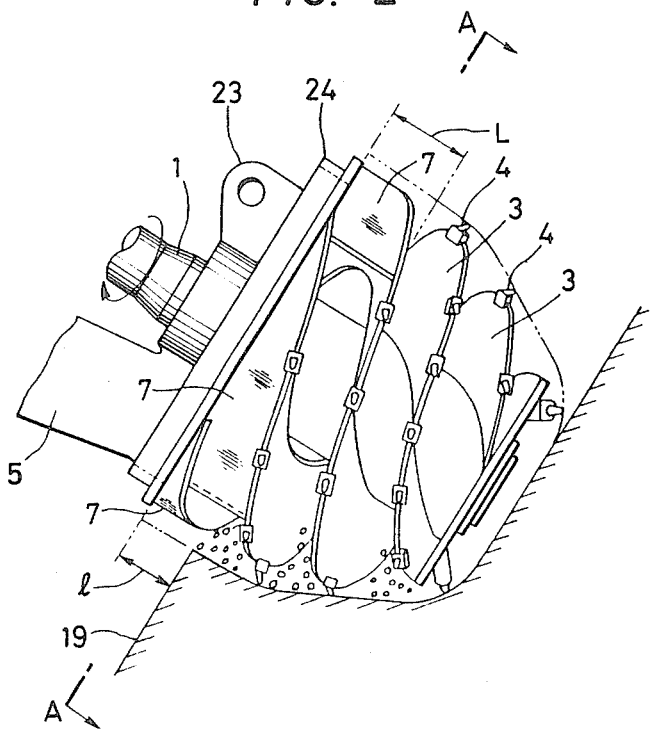
FIG. 2 is a side view of FIG. 1.
Figure 3:
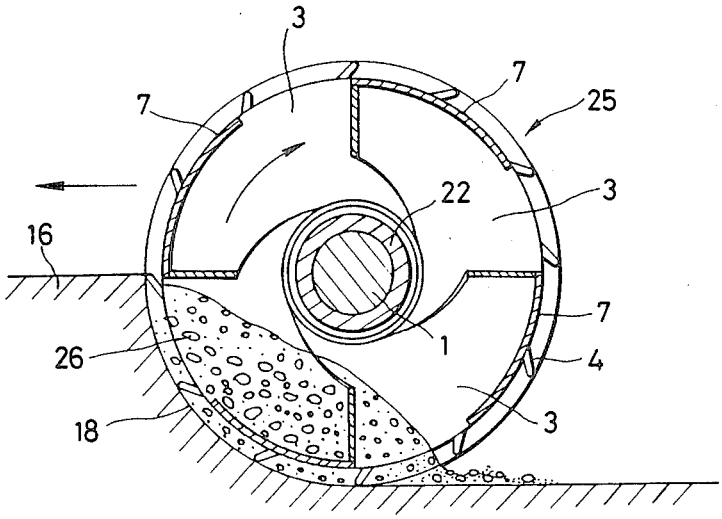
FIG. 3 is a sectional view taken along line A—A of FIG. 2.
Figure 4:
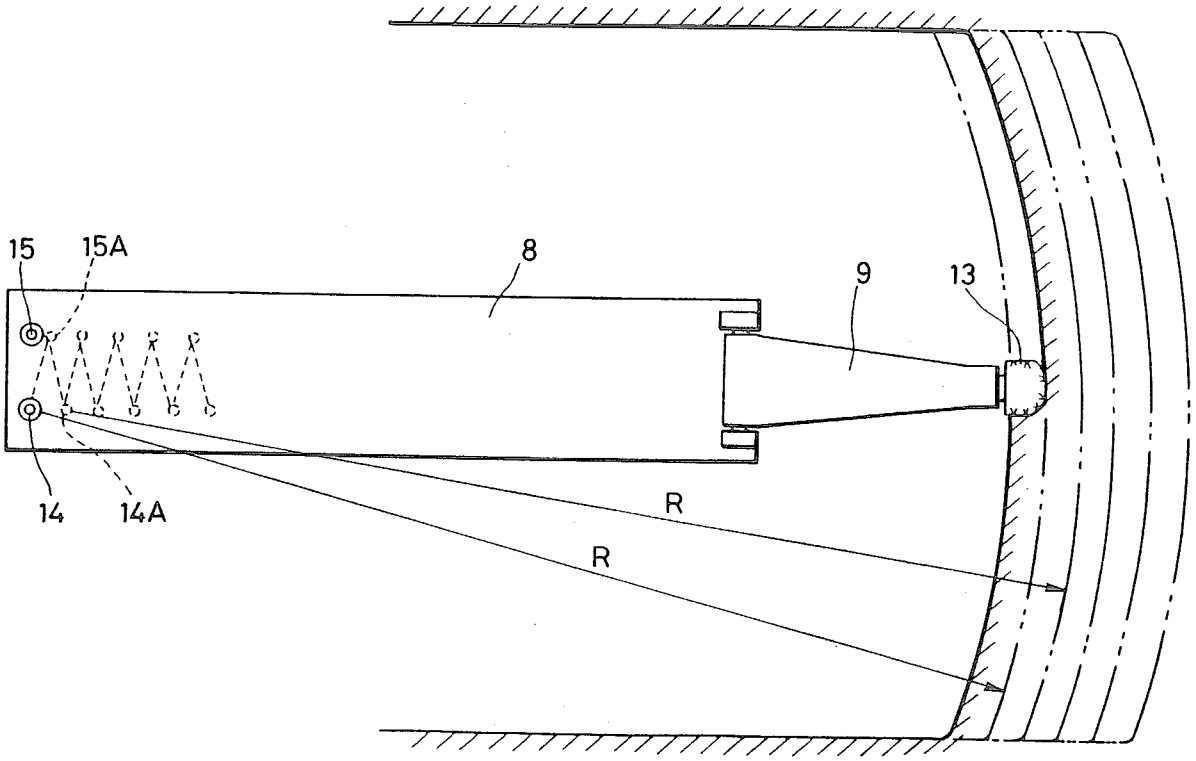
FIG. 4 PRIOR ART
FIG. 4 is a plan view showing the dredger in position to perform dredging.
Figure 5:
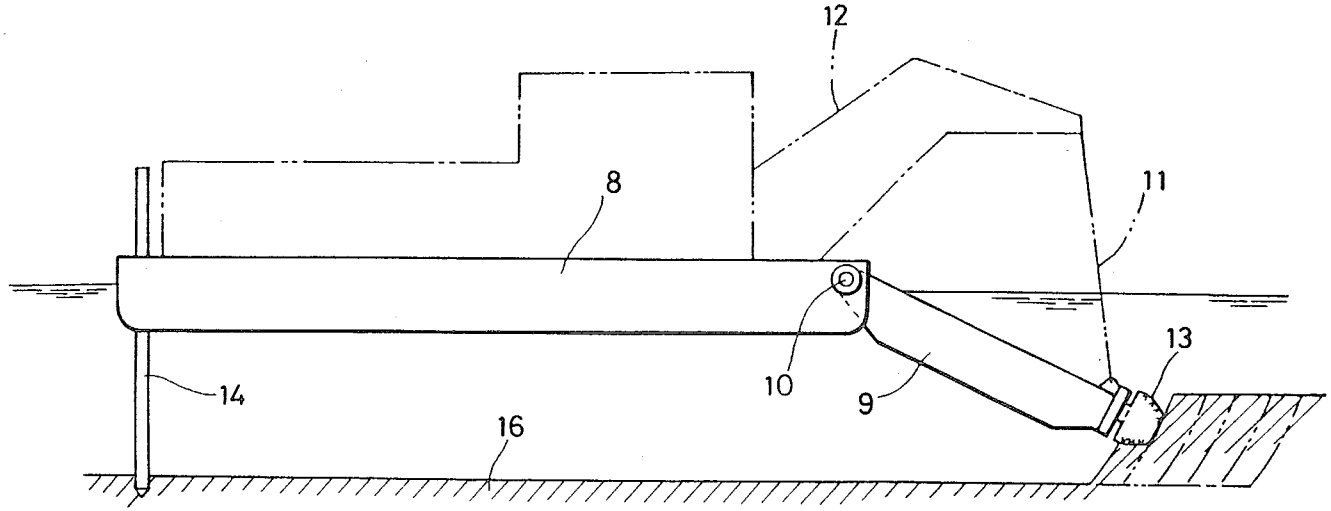
FIG. 5 PRIOR ART
FIG. 5 is a side view of FIG. 4.
Figure 6:
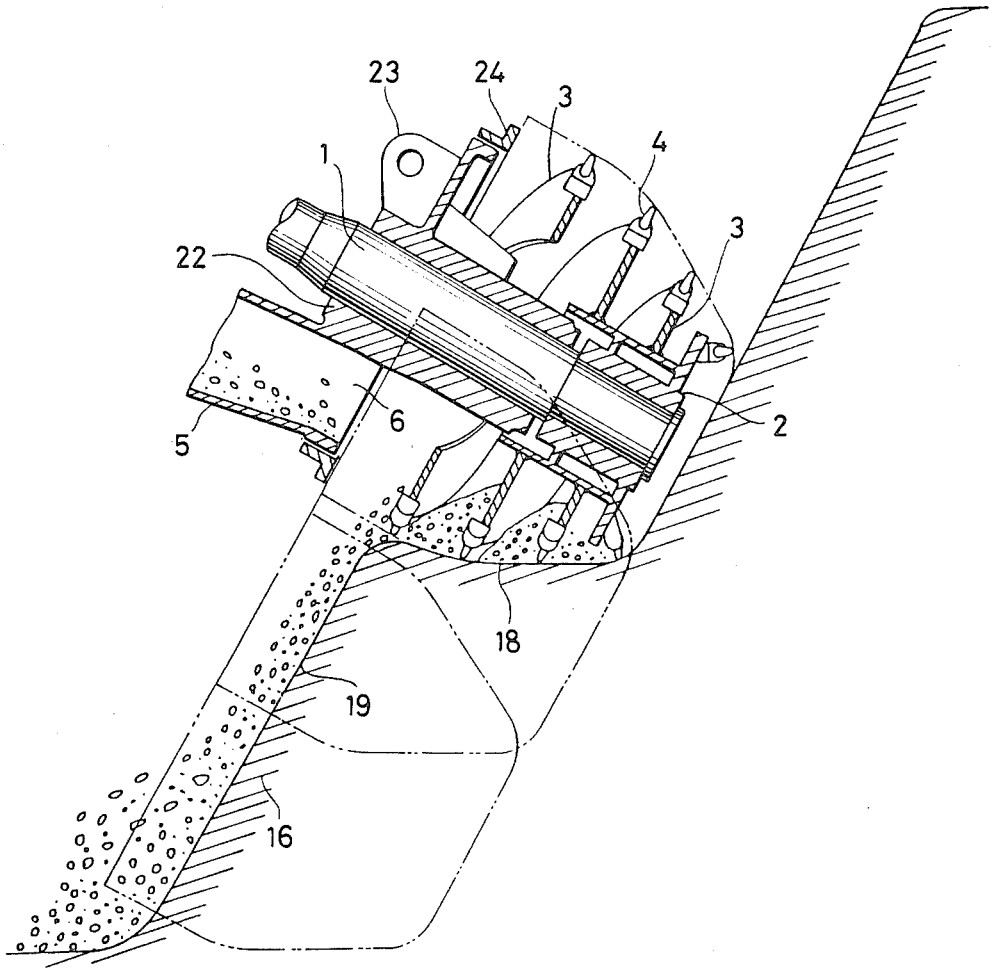
FIG. 6 PRIOR ART
FIG. 6 is a longitudinal side view showing a conventional dredging helical cutter excavating ground at the bottom of water.

FIGS. 1 through 3 show a helical cutter with scoop-in plates of the dredger according to an embodiment of the present invention. A rotary body 2 is secured to the point portion of a driving shaft 1 which is rotated by a driving device. A number of pick boxes 20 are fixed, preferably by welding, on the outer periphery of each helical vane 3 provided on the rotary body 2. Excavating picks 4 are fixed in these pick boxes 20. The helix direction of the helical vanes is set in a right-handed mode when the driving shaft 1 is rotated to the right. The vanes are set in a left-handed mode when the driving shaft 1 is rotated to the left. Thus, the helical vanes 3 illustrated are in the right-handed mode because the driving shaft 1 illustrated is rotating to the right.

The driving shaft rotates the helical vanes 3. The excavating picks 4 free the sand and gravel and the vanes convey the sand and gravel toward the send-out end portion of the helical vanes 3. The send-out end portion of the helical vanes 3 is the end of the helical vanes 3 toward which sand and gravel is conveyed.

The driving shaft 1 is fitted rotatably in a bearing 22 equipped with a disc 21 disposed concentrically with the driving shaft 1. A suspension rope coupling member 23 is formed integrally with the upper portion of the bearing 22. The upper end portion of each helical vane 3 is fixed, preferably by welding, to a circular ring 24 which surrounds the disc 21. In one embodiment of the invention, the circular ring 24 is provided within a plane which is perpendicular to the driving shaft 1. The disc extends perpendicularly to the lengthwise direction of the driving shaft 1. A space is provided between disc 21 and circular ring 24. An inlet port 6 of an earth/sand suction tube 5, supported by the lower portion of the disc 21 is disposed opposite to the lower portion of the send-out end portion of the helical vanes 3. A plurality of arc-like scoop-in plates 7 concentric with the axis of shaft 1 are coupled between the vicinity of the periphery of the end portion of each helical vane 3 and the ring 24. The scoop-in plates 7 are fixed through welding to the helical vanes 3 and ring 24, and the width L of a wider end portion of each scoop-in plate 7 is set to be larger than the gap 1 between the ring 24 and an inclined plane 19 formed through excavation.

When the ground 16 of the bottom of water is to be excavated using the helical cutter 25 with scoop-in plates configured as above, the helical cutter 25 with scoop-in plates is, as shown in FIG. 3, rotated clockwise and moved toward the left while turning. As a result, earth and sand 26 excavated by the excavating picks 4 are conveyed toward the inlet port 6 while being gathered to the left by the helical vanes 3 and guided along an excavated plane 18. Upon reaching the vicinity of the end portion of the excavated plane 18, the earth and sand are scooped in by means of the scoop-in plates 7. Thus, little of the earth and sand 26 flows out from the terminated portion of the excavated plane 18, and most of the earth and sand is sucked into the earth/sand suction tube 5 through the inlet port 6 with the water.

The disc 21 does not rotate with the helical vanes 3. Therefore, the suction tube 5 and coupling member 23 also do not rotate with the helical vanes 3.

While the present invention has been described in its preferred embodiments, it is to be be understood that the invention is not limited thereto, and may be otherwise embodied within the scope of the following claims.

What is claimed is:

1. A dredging helical cutter comprising:

at least one rotary helical vane having a send-out end portion;

a rotary drive shaft for rotating said helical vane about the axis of said drive shaft to cause material to be conveyed to said send-out end portion;

a suction tube having an opening in the vicinity of the send-out portion;

scoop-in means fixed to said at least one rotary vane for conveying material from said send-out end portion to said opening of said suction tube, said scoop-in means comprising a corresponding at least one upstanding, curved plate concentric with said axis and affixed to the periphery of said send-out end portion of said at least one rotary vane.

2. The dredging helical cutter of claim 1, wherein said at least one plate extends substantially perpendicularly to said at least one rotary vane.

3. The dredging helical cutter of claim 2, wherein said at least one rotary vane comprises a plurality of rotary vanes and one of said at least one plates is provided for each one of said rotary vanes.

4. The dredging helical cutter of claim 3, further comprising picks secured to a periphery of each one of said plurality of rotary vanes.

5. The dredging helical cutter of claim 4, further comprising a bearing fitted onto the drive shaft, said bearing supporting said suction tube.

6. The dredging helical cutter of claim 5, further comprising a disc disposed concentrically with the drive shaft, said suction tube including an opening, said disc supporting said opening of the suction tube.

7. The dredging helical cutter of claim 6, further comprising a ring surrounding said disc, said ring being welded to each said scoop-in plate, a space being formed between said ring and said disc.

8. The dredging helical cutter of claim 7, wherein when said rotary helical vanes rotate an inclined plane is formed in an area being dredged and a gap is formed between said inclined plane and said ring, and at least a portion of said scoop-in plates have a width which is greater than said gap.

* * * * *